United States Patent [19]

Giangiulio

[11] 3,942,399

[45] Mar. 9, 1976

[54] ONION SLICING MACHINE

[76] Inventor: Clayton E. Giangiulio, 5 Skyline Drive, Malvern, Pa. 19355

[22] Filed: Feb. 24, 1975

[21] Appl. No.: 552,007

[52] U.S. Cl. ..... 83/4; 83/167; 83/425.1; 83/425.2; 83/437; 83/858

[51] Int. Cl.[2] ..... B26D 4/26; B26D 4/34

[58] Field of Search ..... 83/4, 167, 104.4, 425, 83/425.1, 431, 435, 425.2, 437, 856, 857, 858

[56] References Cited

UNITED STATES PATENTS

| | | | |
|---|---|---|---|
| 1,321,640 | 11/1919 | Illinger | 83/851 |
| 1,771,456 | 7/1930 | Alexander | 83/425.2 |
| 2,535,261 | 12/1950 | Brown | 83/425.2 |

*Primary Examiner*—Travis S. McGehee
*Assistant Examiner*—W. D. Bray
*Attorney, Agent, or Firm*—Caesar, Rivise, Bernstein & Cohen, Ltd.

[57] ABSTRACT

Apparatus for slicing onions and other hard vegetables. The apparatus comprises carrier means mounted for movement through a cutting path in a first direction. A plurality of cutting blades is disposed within the path in a downwardly descending ramp. Each of the blades includes a leading edge and a trailing edge, with the leading edge forming the cutting edge of the blade. The blades are sequentially offset from one another in said one direction and parallel to one another in the direction normal to said one direction, with the leading edge of one blade spaced from the trailing edge of the preceding blade by a distance at least equal to the thickness of the blade.

The carrier means serves to carry the vegetable through the path and into sequential contact with succeeding blades to effect the sequential slicing of the vegetable.

The carrier means comprises a base for supporting the vegetable and a pusher member. The pusher member is arranged to apply a force on the vegetable at an area thereon opposite to the blade then in contact with the vegetable to force the vegetable cleanly through the blade. The pusher member is preferably curved and is arranged to pivot as the carrier moves along the cutting path while making contact with the base at all times to preclude any portion of the vegetable from falling out of the carrier.

21 Claims, 11 Drawing Figures

ONION SLICING MACHINE

This invention relates generally to apparatus for cutting vegetables and more particularly to manual apparatus for cutting onions and other hard vegetables into slices.

Various manually operable apparatus and devices for slicing vegetables and fruits have been disclosed in the patent literature and some are commercially available.

Such devices commonly include plural blades disposed parallel to one another and lying either in a horizontal or vertical plane(s). A vegetable is forced through the blades by a pusher assembly to effect the slicing of the vegetable. See for example U.S. Pat. Nos: 557,914 (Struble et al.), 1,003,674 (Veitch), 2,250,028 (Miller), 2,323,760 (Walfinger), 2,441,027 (Masrob), 2,487,431 (Floyd), 2,911,023 (Kennedy), 2,924,256 (Reiland) and 3,765,287 (Borner).

While such devices may be effective for slicing vegetables into elongated strips, such as strips used for making french fries, such devices are not suitable for effectively slicing onions into thin slices or wafers. In particular, insofar as onions are concerned, prior art manual slicing machines have exhibited the following drawbacks: they are slow in operation and require the application of a substantial force to effect the slicing. In addition, prior art slicing machines frequently allow the vegetable to rotate during the slicing operation, thereby producing non-uniform and misshapen slices. The rotation of the vegetable during the slicing operation in prior art slicing machines is also frequently accompanied by the crushing of the entire vegetable or only the part being sliced and the squeezing of juice therefrom. The above described disadvantages are particularly significant in large scale commercial food processing or preparing operations.

Accordingly, it is a general object of this invention to overcome the disadvantages of the prior art vegetable slicers.

It is a further object of this invention to provide a manually operable device for slicing onions and other hard vegetables into uniform slices.

It is still a further object of this invention to provide a quick and efficient, manually operable device for slicing onions and other hard vegetables.

It is yet a further object of this invention to provide a simple and inexpensive, manually operable device for slicing onions and other hard vegetables.

These and other objects of this invention are achieved by providing apparatus for slicing hard vegetables. The apparatus comprises carrier means mounted for movement through a cutting path in a first direction. Plural cutting blades are disposed within the path and have respective cutting edges sequentially offset from one another in said one direction and parallel to one another in a direction normal to said one direction. The carrier means serves to carry the vegetable through the path and into sequential contact with succeeding blades to effect the slicing of the vegetable. The carrier comprises a base for supporting the vegetable and a pusher for applying force on the vegetable at an area thereon which is opposite to the blades then in contact with the vegetable to force the vegetable cleanly through such blades.

Other objects and many of the attendant advantages of this invention will be readily appreciated as the same becomes better understood by reference to the following detailed description when considered in connection with the accompanying drawings, wherein.

Referring now in greater detail to the various figures of the drawing wherein like reference characters refer to like parts, there is generally shown at 20 in FIG. 1 an improved manually operable onion or hard vegetable slicer in accordance with this invention.

Figure 1:
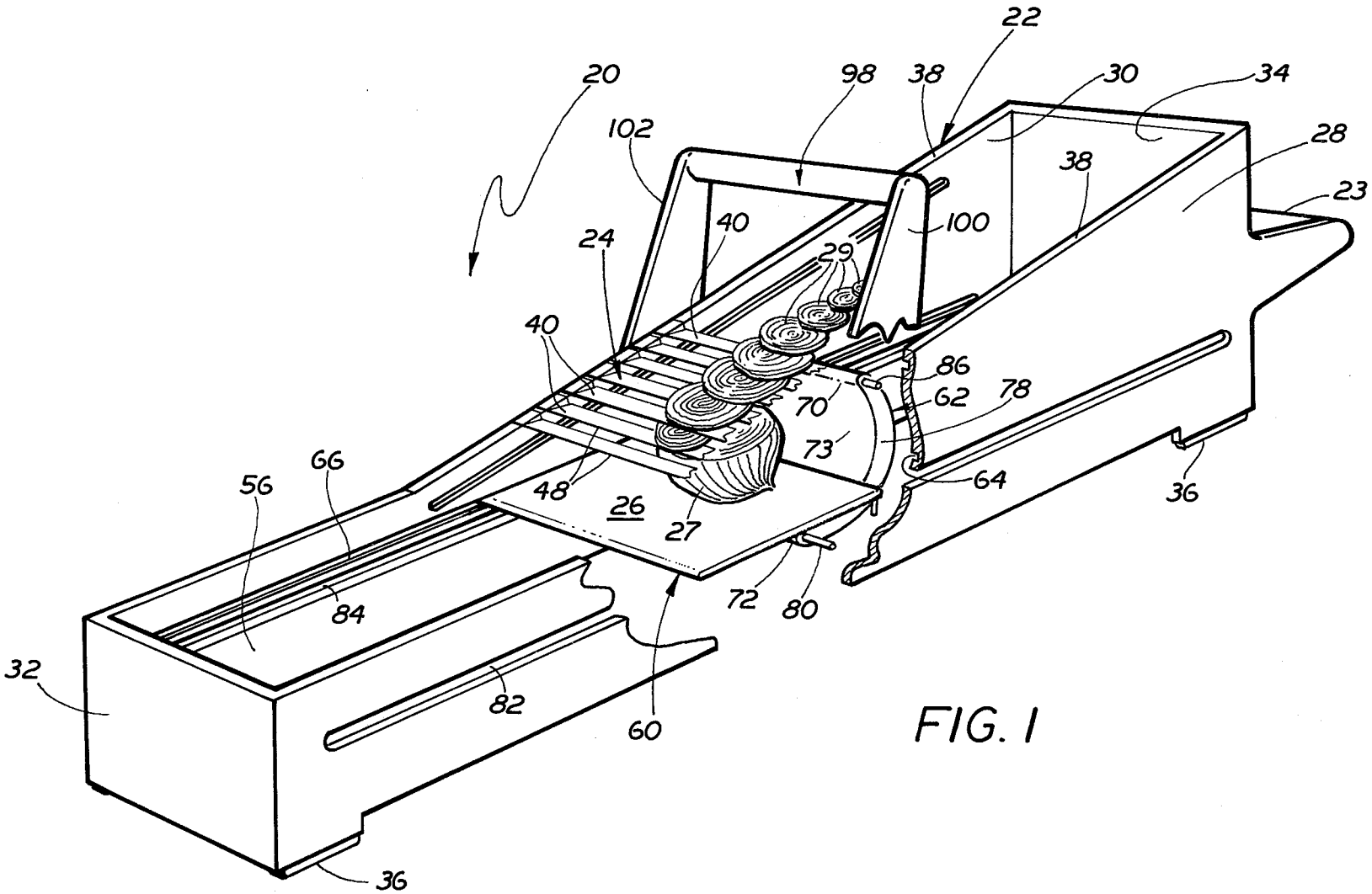
FIG. 1 is a perspective view of an onion slicing machine in accordance with this invention.
Figure 2:
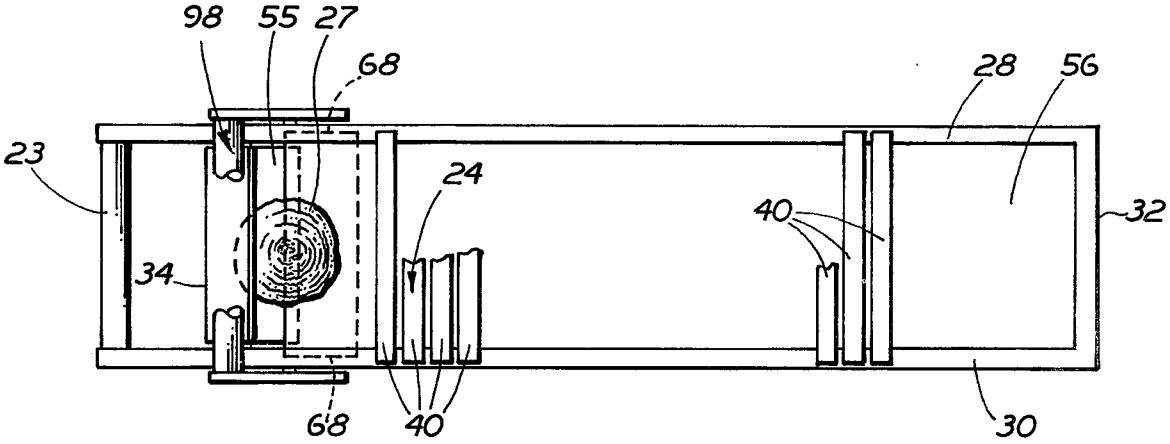
FIG. 2 is a decreased top plan view, partially broken away, of the device shown in FIG. 1.

The device 20 basically comprises a frame 22 for supporting a cutting blade assembly 24, formed of plural cutting blades to be described later, and a vegetable carrier assembly 26. The carrier assembly is basically arranged to carry an onion 27 or other hard vegetable in a first direction, hereinafter called the downstream direction, along a horizontal cutting path and sequentially through the blades of the cutting assembly disposed therein to slice the onion into uniform slices or wafers 29.

The frame 22 is an open one and comprises a pair of side walls 28 and 30, a front wall 32 and a rear wall 34. A foot 36 is provided in each corner of the frame 22 for supporting the frame on the work or cutting table. A handle 23 is provided at the back wall to enable the device to be carried readily.

As can be seen in FIG. 1 the respective top edges 38 of the side walls 28 and 30 are ramp-like, that is they descend downward in the downstream direction from the rear wall 34 to the front wall 32 of the frame 22 at a predetermined angle to the horizontal cutting path.

Figure 5:
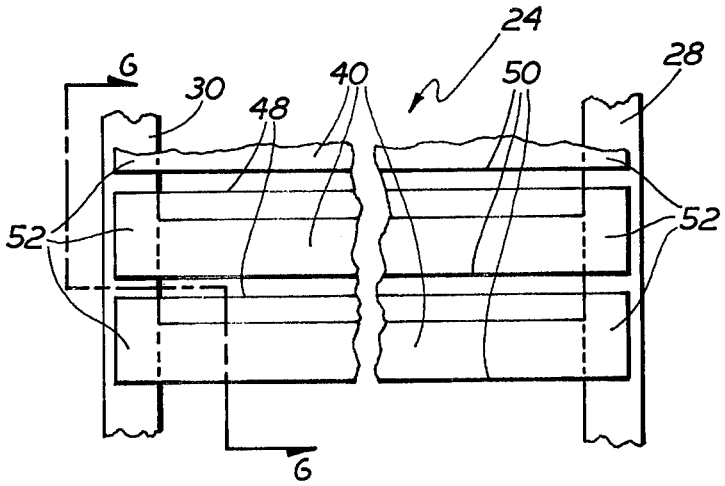
FIG. 5 is an enlarged top elevational view of a portion of the blade assembly of the device shown in FIG. 1.
Figure 6:
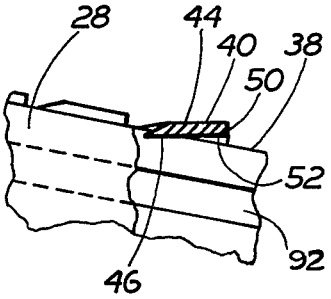
FIG. 6 is a sectional view taken along line 6—6 of FIG. 5.

The blade assembly basically comprises a plurality of individual cutting blades which are mounted on the top edge of the side walls 28 and 30. As can be seen in FIGS. 5 and 6 each blade is in the form of a generally planar elongated strip 42 having a planar top surface 44 and a planar bottom surface 46. Each blade is of a predetermined width and includes a front edge 48 and a rear edge 50 spaced from the front edge. The top surface 44 of each blade is tapered sharply contiguous with the front edge to define the cutting edge of the blade. Mounting flanges 52 are provided at the respective sides of each of the blades. The flanges 52 are generally planar and include openings (not shown) through which fastening means (not shown), such as screws, extend to secure the flanges to the respective top edges of the side walls 28 and 30 of the frame 22.

The flanges extend at a predetermined angle with respect to the planar portion 42 of the blade. The predetermined angle is substantially the same as the angle that the top edges 38 of the side walls of the frame make with respect to the horizontal cutting path, such that when secured in place on the top edges of the frame, the planar portion 42 of each blade is disposed in a horizontal plane and parallel to the cutting path.

The blades are mounted at equal intervals along the descending side wall edges such that they lie in equally spaced parallel planes, but with their respective cutting edges sequentially offset in the downstream direction along the cutting path. Accordingly, the cutting edges of all the blades are in a common plane, which according to a preferred embodiment of this invention is parallel to the top edges of the side walls 28 and 30.

As will be considered in detail later the heretofore described downwardly stepped arrangement of the blades in the downstream direction along the cutting path enables the slicing of wafers 29 from the onion 27 by the sequentially succeeding blades 40, starting at the top of the onion and working downward, as the onion is carried down the cutting path and through the blades by the carrier means. This is shown schematically in FIG. 1 and in detail in FIGS. 8–11.

By virtue of the fact that only a few blades are in contact with the onion to slice it at any one instant (as will be seen clearly later) relatively little force is required to effect the clean and quick slicing of the entire onion.

Figure 7:
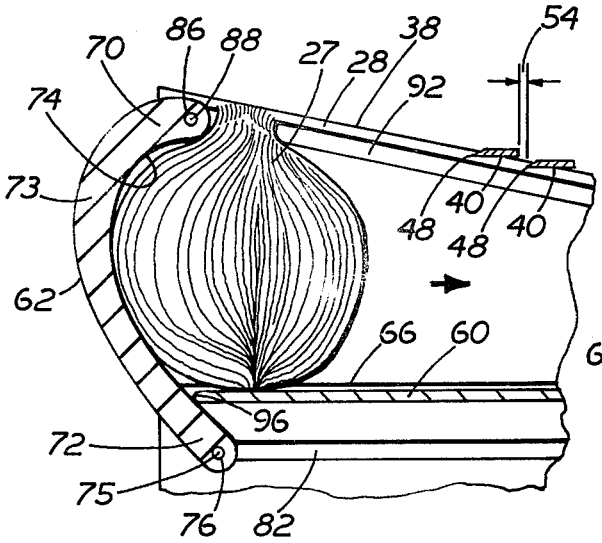
FIG. 7 is a side elevational view, partially in section, of a portion of the device at the beginning point in the cutting operation.

As can be seen clearly in FIG. 7 the blades are sequentially offset in a downstream direction in such a manner that there is a predetermined dimensioned space, denoted by the reference numeral 54 and measured in the downstream direction, between the rear edge 50 of one blade and the cutting edge 48 of the next succeeding downstream blade. In accordance with the preferred embodiment of this invention, the predetermined spacing is at least equal to the thickness of the blade stock, i.e., the dimension between the top surface 44 and the bottom surface 46 of the blade 40, but is less than three times the thickness thereof. Such an arrangement enables the slices formed by the cutting edges to pass freely between the blades without being squeezed or crushed thereby.

It has been found that if the spacing between the rear edge of one blade and the cutting edge of the next downstream blade is greater than approximately three times the thickness of the blade stock, an undesirable rotational force in the counter-clockwise direction (in views of FIGS. 8–11) may be imparted to the onion. Such a force results in the production of non-uniform slices, the crushing of the slices and squeezing of the juice therefrom, which undesirable results have characterized prior art devices as described heretofore.

In accordance with the preferred embodiment of this invention, the thickness of each blade is approximately 0.06 inch (1.5 mm), the width of each blade, that is the distance between the cutting edge 48 and the rear edge 50 is approximately 0.56 inch (14.3 mm) and the spacing between the rear edge of one blade and the cutting edge of the next succeeding downstream blade is approximately 0.15 inch (3.8 mm).

The plane in which all the cutting edges lie, called the plane of the blade assembly, makes an angle within the range of 10° to 15° with the horizontal cutting path. The angle selected is a function of two countervailing factors. The more shallow the angle the fewer blades make contact with the onion at any given moment during the cutting operation. With less blades in contact with the onion at any given time, less force is required to effect the slicing. However, the use of a blade assembly whose plane is a shallow angle necessitates the use of a relatively long support frame to accommodate all of the blades in the cutting path. This is undesirable from a size standpoint.

It has been found that by mounting the blades such that the plane of their cutting edges descends downward at an angle of approximately 12° with the cutting path an efficient and readily operable cutting device results, which device is still relatively compact in size.

With the blades dimensioned, disposed and spaced like that described heretofore the device 20 produces uniform and clean onion slices of approximately 0.15 inch (48 mm) thickness. Such slices are suitable for general use. By increasing the width of the blade while maintaining the proper spacing between the rear edge of one and the cutting edge of the succeeding blade, as described heretofore, correspondingly thicker onion slices will be produced. Such thick slices may be used for special purposes, e.g., for french fried onion rings.

As can be seen in FIG. 1 the blade assembly is mounted in approximately the middle of the frame 22. To the rear of the blade assembly the frame is open and this open area 55 serves as the onion receiving portion of the device, that is the station at which the onion is inserted on the carrier for subsequent slicing. At the front of the blade assembly, that is immediately downstream of the last or lowest blade, the frame is also open to provide a space 56 for receiving and collecting onion slices produced by the operation of this device.

As noted heretofore the function of the carrier assembly 26 is to support and carry the onion 27 down the cutting path and through the descendingly stepped blades of the blade assembly. In accordance with another aspect of this invention, the carrier includes means for directing the cutting force applied to the onion to the area thereon which is opposite to the blades then in contact with the onion. This feature precludes the onion from rotating during the slicing operation and ensures that the slices are uniform and not wedge shaped or otherwise misshapen, crushed or squeezed dry. In addition, this feature ensures that the slicing operation occurs quickly and with a minimum of applied force, since the major force component effecting the slicing of the onion is along the cutting path and not at an angle thereto.

As can be seen in FIG. 1 the carrier basically comprises a base member 60 and a pusher 62. The base member is a horizontally disposed planar member adapted to slide along the cutting path and to support the onion for carriage through the blade assembly. In order to accomplish those ends a pair of horizontal tracks 64 and 66 (FIGS. 1 and 6) are cut in the inside surfaces of the side walls 28 and 30, respectively. The outside edges 68 of the base member 60 are disposed loosely within the respective tracks to enable the base to be slid therealong.

The pusher member 62 is arranged to move the base 60 along the tracks 64 and 66 while ensuring that the cutting force is applied to the onion at the proper area as described above. To that end, the pusher member 62 includes an upper end 70, a lower end 72 and a curved intermediate portion 73 therebetween, with the radius of curvature of said portion decreasing from the lower end 72 to the upper end 70 such that when viewed laterally, like that in FIGS. 7–11, the curved pusher member appears as a portion of a spiral. As will be described in detail the inner surface 74 of the curved pusher serves as the force applying means for the onion during the cutting operation and also serves as means effecting the translation of the base member along the horizontal cutting path.

Figure 4:
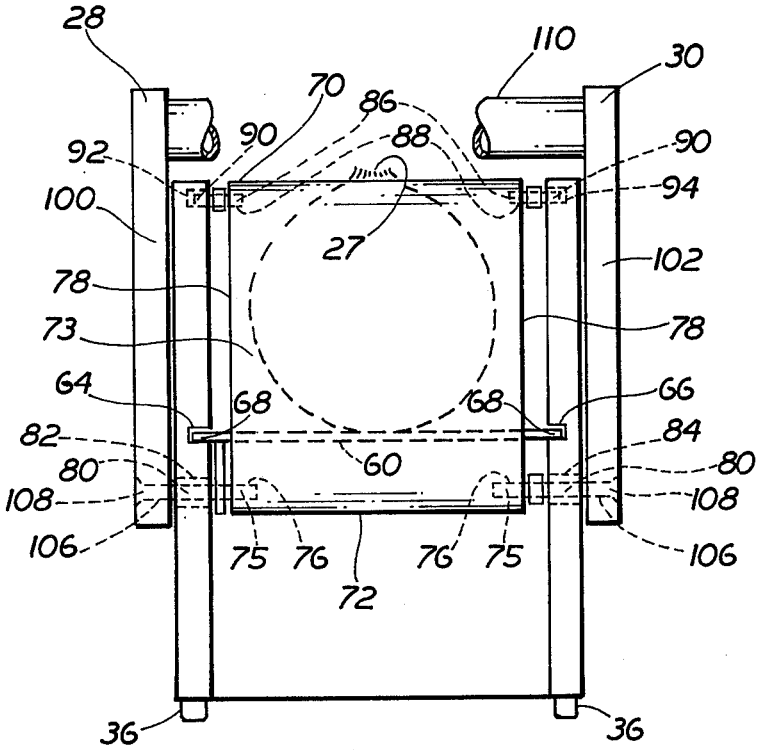
FIG. 4 is an end view, partially broken away, of the device shown in FIG. 1.

The pusher is mounted in the following manner. A pair of bolts 75 (FIG. 4), each including a threaded end are screwed within coaxial threaded openings 76 extending into the side edges 78 of the pusher adjacent the lower end 72 thereof. The coaxial bolts 75 serve as a lower pivot axis about which the pusher rotates. To that end, an unthreaded midportion 80 of each bolt extends outward from the side edges 78 of the pusher and through a respective one of a pair of horizontal slots 82 and 84 in the side walls 28 and 30, respectively. The slots extend almost the full length of the frame in the side walls. The upper end 70 of the pusher is mounted in a similar manner. Accordingly, a pair of rods 86 each including a threaded end are screwed within coaxial threaded openings 88 extending into the side edges 78 of the pusher adjacent the upper end 70 thereof. The coaxial rods 86 serve as an upper pivot axis about which the pusher rotates. To that end, the unthreaded ends 90 of the rods extend outward from the side edges 78 of the pusher and within a pair of parallel tracks 92 and 94 cut in the inside surface of the side walls 28 and 30, respectively. As can be seen the tracks 92 and 94 descend downward in the downstream direction toward the horizontal path through which the base member 60 moves. The angle that the tracks 92 and 94 make with respect to the horizontal cutting path is the same as the angle of the plane of the blade assembly, e.g., approximately 12°.

Figure 3:
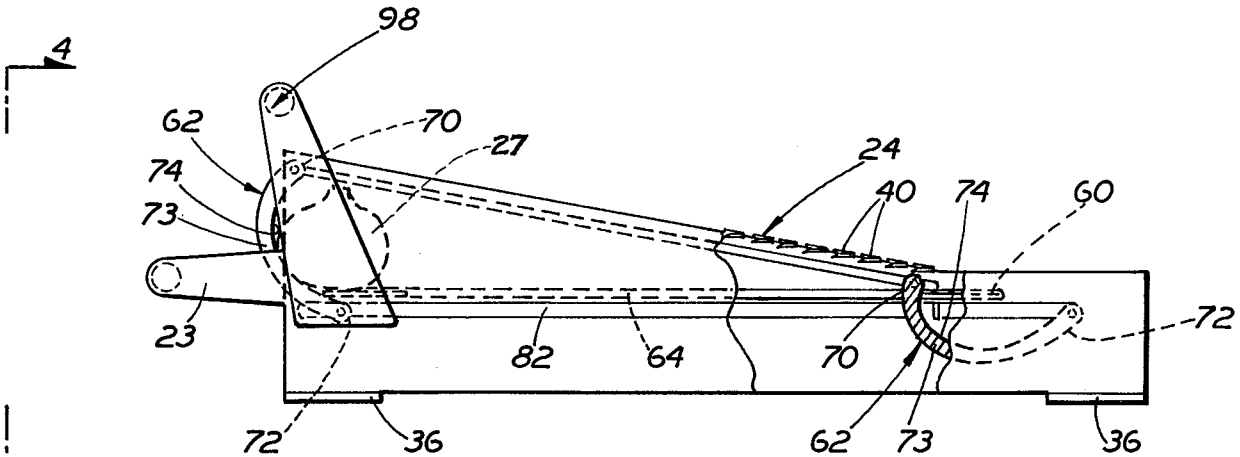
FIG. 3 is a side elevational view, partially broken away, of the device shown in FIG. 1.

As will be described in detail later, the pusher member 62 is arranged to slide in the downstream direction down the cutting path starting from the position shown by the phantom lines in FIG. 3, and ending at the position shown by the solid lines therein. All during such movement the pusher pivots counterclockwise about the upper pivot axis and the lower pivot axis as viewed in FIGS. 7–11. Such rotation ensures that a cutting force is applied to the onion by the inside surface 94 of the pusher and opposite to the blades then in contact with the onion, while another portion of the curved inside surface of the pusher maintains contact with the upstream edge 96 of the base 60 to effect the sliding thereof down the cutting path, irrespective of the position of the carrier in the cutting path. In addition, the contact between the pusher and the upstream edge of the base ensures that no onion pieces fall out through the bottom of the carrier.

It should be pointed out at this juncture that the pusher of the instant invention can be shaped differently from the curved shape shown in the drawing. However, it is of utmost importance that such a different shaped pusher includes some portion(s) which is (are) in contact with the onion at an area thereon opposite to the blades then in contact with the onion, irrespective of the carrier's position within the cutting path. As will be appreciated from a discussion of the operation of the preferred embodiment shown herein during the bulk of the cutting cycle the top portion of the pusher's inside surface is the portion applying the cutting force to the onion.

While I contemplate the use of motor means to move the pusher, in accordance with the preferred embodiment shown herein, the movement of the pusher is accomplished manually, via a handle assembly 98. As can be seen in FIG. 3 the handle assembly 98 includes a pair of side bars 100 and 102 including openings 104 and 106, respectively, through which the heads 108 of bolts 80 extend to pivotally secure the side bars to the carrier assembly 26. A handle bar 110 bridges and is connected between the side bars 100 and 102 to serve as the portion of the handle which is grasped in the operator's hand.

As should be appreciated, by merely pushing the handle assembly forward the operator moves the carrier assembly 26 down the horizontal cutting path. The horizontal slots 82 and 84 serve to guide such horizontal motion while the coaction of the rods 86 and tracks 92 and 94 effect the rotation of the pusher as described heretofore to ensure proper force application.

Operation of the onion slicing device 20 can best be appreciated by reference to FIGS. 7–11. With the carrier assembly 26 in its retracted position, that is pulled back close to the rear wall 32 of the frame, an onion 27 or other hard vegetable to be sliced is inserted within the opening 55 in the frame and onto the planar base 60 of the carrier assembly. The onion is disposed on the base immediately adjacent the rear edge 96 and in abutment with the inside surface 74 of the pusher as shown in FIG. 7. The onion is now ready for slicing.

Figure 8:
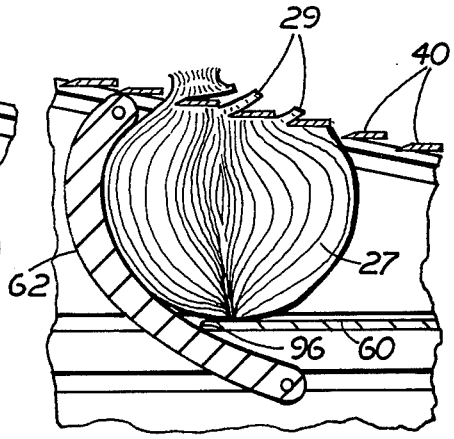
FIG. 8 is a view similar to that of FIG. 7 but showing the device during the production of the first few slices from an onion.

The operator grasps hand bar 110 and begins pushing forward, that is downstream, on the handle. The translational force applied to the handle bar is coupled through the handle assembly to the carrier assembly, whereupon the carrier assembly with the onion thereon begins moving down the cutting path, with the pusher forcing the onion carrying base therealong. As the carrier moves down the cutting path the pusher rotates counterclockwise as can be seen in FIG. 8. By the time that the onion reaches the first blade 40 of the blade assembly, that is the highest disposed blade, the pusher has rotated to a position such that some portion of the inside surface thereof in contact with the onion (in the view shown in FIG. 8 this portion is at the top 70 of the pusher) is in contact with that portion of the onion directly opposite to the first few blades. Accordingly, the major component of the cutting force applied by the operator is applied to the onion aligned with the blades then in contact therewith. This action ensures that the cuts are made easily and with a minimum of applied force.

Since, as can be seen in FIG. 8, the onion first makes contact with the top blade and proceeds to make contact with each succeeding blade, the first slice of the onion occurs at the top thereof. Each succeeding slice is formed between one blade and the next succeeding blade and proceeds down the onion.

By virtue of the tapered cutting edge of each blade and the spacing between the blades the slices are formed cleanly and uniformly and curve upward to exit from the blade assembly.

Figure 9:
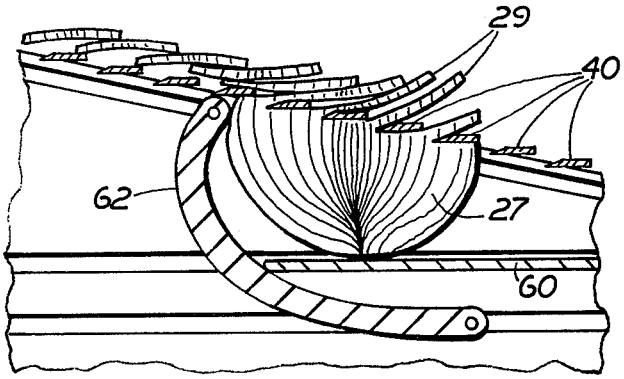
FIG. 9 is a view, similar to that of FIG. 8 at an intermediate point in the operation of the device.
Figure 10:
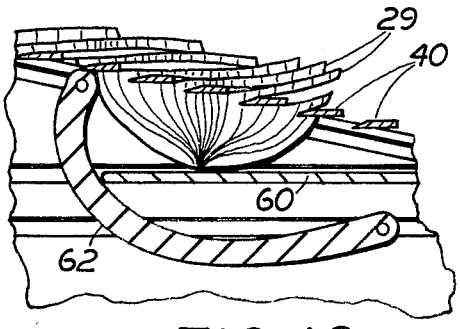
FIG. 10 is a view, similar to that of FIG. 9 showing the device at a later point in the operation thereof.

In FIGS. 9 and 10 there is shown succeeding points in the cutting operation of the device 20. As can be seen therein, at all times some portion of the inside surface 73 of the pusher 62 is in contact with the portion of the onion opposite the blade then cutting, while some portion of such surface is in contact with the edge 96 of the base 60. This action continues to ensure proper slicing and that no pieces fall out through the bottom of the carrier assembly.

Figure 11:
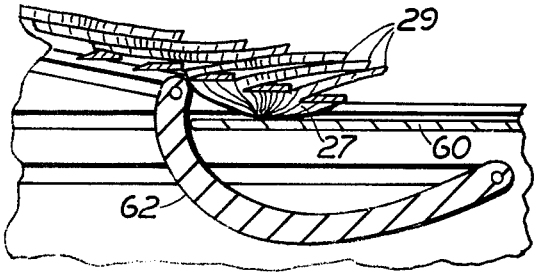
FIG. 11 is a view, similar to FIG. 10 but showing the device at the end of the slicing operation.

As can be seen in FIG. 11, even at the end of the cutting cycle, the pusher is still in proper contact with the onion to effect the clean slicing thereof by the last, that is lowest, blades.

Upon completion of the traversal of the cutting path in the downstream direction the entire onion will have been sliced with very little wastage. The slices exit the blade assembly and slide down the assembly and into the open front portion 56 of the frame for collection. To that end, a pan may be disposed within space 56.

The handle assembly is then retracted to pull the carrier assembly back to its starting position for receipt of another onion to be sliced in an identical manner.

It should be pointed out at this juncture that while the cutting blades are shown as being planar strips, it is to be understood that such elements can be of different shapes, e.g., crinkle blades or ribbed blades.

As should be appreciated from the foregoing, the onion slicing device of the instant invention is quick and simple to operate, is capable of relatively high speed operation and produces slices which are of a uniform size. In addition, the device is extremely simple in construction and hence can be made inexpensively, provides easy access to its cutting components to expedite cleaning, can be assembled and disassembled readily for service and is nevertheless relatively compact and light weight for ready transportability. In short, the device 20 of the instant invention presents a viable approach to onion slicing for large scale food operations.

Without further elaboration, the foregoing will so fully illustrate my invention, that others may, by applying current or future knowledge, readily adapt the same for use under various conditions of service.

What is claimed as the invention is:

1. Apparatus for slicing hard vegetables comprising carrier means mounted for movement through a cutting path in a first direction, plural cutting blades disposed within said path and having respective cutting edges sequentially offset from one another in a ramp arrangement in said one direction and parallel to one another in the direction normal to said one direction, said carrier means serving to carry said vegetable through said path and into sequential contact with succeeding blades to effect the sequential slicing of said vegetable, said carrier means comprising a movable base for supporting said vegetable and a pusher member for moving said base along said path to carry said vegetable through said blades and for applying a force to said vegetable and directing said force at an area thereon opposite to the blade then in contact with said vegetalbe and maintaining said force thereon irrespective of the position of said vegetable along said path to force said vegetable cleanly through said blade.

2. The apparatus of claim 1 wherein said ramp descends in said one direction.

3. The apparatus of claim 2 wherein said path is linear.

4. Apparatus for slicing hard vegetables comprising carrier means mounted for movement through a cutting path in a first direction, plural cutting blades disposed within said path and having respective cutting edges sequentially offset from one another in said one direction and parallel to one another in the direction normal to said one direction, said carrier means serving to carry said vegetable through said path and into sequential contact with succeeding blades to effect the sequential slicing of said vegetable, said carrier means comprising a base for supporting said vegetable and a pusher member pivotable as it moves along said path in said first direction for applying a force on said vegetable at an area thereon opposite to the blade then in contact with said vegetable to force said vegetable cleanly through said blade.

5. The apparatus of claim 4 wherein said pusher member is curved and includes an upper portion and a lower portion.

6. The apparatus of claim 5 wherein said cutting edges are mounted in a ramp with said ramp descending in said one direction and with the lower portion of the curved pusher member being arranged to move in said first direction while the upper portion thereof moves in a path down the ramp whereupon the curved pusher member pivots as the carrier moves along said cutting path.

7. The apparatus of claim 6 wherein the curved pusher member is mounted with respect to said base to effect the movement of said base along the path as the pusher is moved, and said pusher making contact with said base at all times to preclude any portion of the vegetable from falling out of said carrier.

8. The apparatus of claim 7 wherein said path is linear and wherein the radius of curvature of said pusher decreases from its bottom portion to its top portion.

9. The apparatus of claim 1 wherein each of said blades includes a leading edge and a trailing edge, with the leading edge forming the cutting edge thereof, said blades being disposed in a descending ramp and offset from one another such that the leading edge of one blade is spaced from the trailing edge of the preceding blade by a distance at least equal to the thickness of the blade.

10. The apparatus of claim 9 wherein said distance is no more than three times the thickness of said blade.

11. The apparatus of claim 10 wherein said descending ramp is at approximately 10° to 15° with respect to said first direction.

12. The apparatus of claim 11 wherein said ramp is at approximately 12° with respect to said first direction.

13. The apparatus of claim 12 wherein said blade thickness is approximately 1.5 mm.

14. The apparatus of claim 13 wherein the distance is approximately 4 mm.

15. The apparatus of claim 10 wherein the blade thickness is approximately 1.5 mm.

16. The apparatus of claim 15 wherein the distance is approximately 4 mm.

17. The apparatus of claim 7 wherein each of said blades includes a leading edge and a trailing edge, with the leading edge forming the cutting edge thereof and with said blades being disposed in a descending ramp and offset from one another such that the leading edge of one blade is spaced from the trailing edge of the preceding blade by a distance at least equal to the thickness of the blade.

18. The apparatus of claim 17 wherein said distance is no more than three times the thickness of said blade.

19. The apparatus of claim 18 wherein said ramp is at approximately 12° with respect to said first direction.

20. The apparatus of claim 19 wherein said blade thickness is approximately 1.5 mm.

21. The apparatus of claim 20 wherein the distance is approximately 4 mm.

* * * * *